US006974066B2

(12) United States Patent
Abe

(10) Patent No.: US 6,974,066 B2
(45) Date of Patent: Dec. 13, 2005

(54) BUILT-IN EQUIPMENT TYPE STAPLER

(75) Inventor: Shinya Abe, Saitama (JP)

(73) Assignee: Max Co., Ltd., Tokyo (JP)

( * ) Notice: Subject to any disclaimer, the term of this patent is extended or adjusted under 35 U.S.C. 154(b) by 54 days.

(21) Appl. No.: 10/488,989

(22) PCT Filed: Sep. 10, 2002

(86) PCT No.: PCT/JP02/09229

§ 371 (c)(1),
(2), (4) Date: Mar. 10, 2004

(87) PCT Pub. No.: WO03/022539

PCT Pub. Date: Mar. 20, 2003

(65) Prior Publication Data

US 2004/0238589 A1 Dec. 2, 2004

(30) Foreign Application Priority Data

Sep. 11, 2001 (JP) ..... 2001-275405

(51) Int. Cl.[7] ..... B27F 7/19
(52) U.S. Cl. ..... 227/111; 227/110; 227/155
(58) Field of Search ..... 227/110, 111, 227/123, 129, 155, 107

(56) References Cited

U.S. PATENT DOCUMENTS

| | | | | | |
|---|---|---|---|---|---|
| 4,444,491 | A | * | 4/1984 | Rinehart et al. | 355/50 |
| 4,936,497 | A | * | 6/1990 | Ordelt | 227/5 |
| 5,029,831 | A | * | 7/1991 | Green | 270/58.08 |
| 5,181,643 | A | * | 1/1993 | Radtke | 227/110 |
| 5,460,314 | A | * | 10/1995 | Udagawa | 227/155 |
| 5,806,750 | A | * | 9/1998 | Yamanushi et al. | 227/155 |
| 6,142,353 | A | * | 11/2000 | Boss et al. | 227/44 |
| 6,223,965 | B1 | * | 5/2001 | Nakatsuka | 227/111 |
| 6,641,024 | B2 | * | 11/2003 | Sato et al. | 227/155 |

* cited by examiner

*Primary Examiner*—Scott A. Smith
(74) *Attorney, Agent, or Firm*—Morgan, Lewis & Bockius LLP

(57) ABSTRACT

In a built-in stapler built into a machine including a driver unit (2) for ejecting staples against sheets of paper to be bound by a motor-driven driver; and a clincher unit (3) for folding legs of the staples, the driver unit and the clincher unit being held independently from each other with a determined distance therebetween so as to move respectively, stopping positions at one ends of respective moving ranges of the units (2, 3) are set to be displaced from each other, and the stopping position of the clincher unit (3) is provided at an inner side in the moving range than the stopping position of the driver unit (2).

7 Claims, 3 Drawing Sheets

BUILT-IN EQUIPMENT TYPE STAPLER

TECHNICAL FIELD

The present invention relates to an electric stapler of a type built into a machine which is incorporated in the machine such as a copying machine and a facsimile machine, for the purpose of binding copying paper or paper received by facsimile into stacks of every determined number of sheets.

BACKGROUND ART

In a field of business machines such as a copying machine and a facsimile machine, there has been known a machine with a built-in stapler which is driven by an electric motor or the like for the purpose of automatically binding sheets of paper which have been copied or received through these machines into stacks of every determined number of sheets. An ordinary stapler which is used on a desk has such a structure that a magazine adapted to successively ejecting staples which have been charged in the magazine against the sheets of paper to be bound, and a clincher adapted to fold tip ends of staple legs which have passed through the sheets of paper, are pivotally connected to each other at their one ends. However, the built-in stapler, which is built into the business machine as described above, is constructed in such a manner that a driver unit which is driven by an electric motor to successively eject the staples charged in the magazine against the sheets of paper to be bound, and a clincher unit for folding the tip ends of the staple legs which have passed through the sheets of paper to be bound along a back face of the sheets of paper, are provided independently from each other. Both the units are held on a frame of the machine independently from each other, so as to freely move with a determined distance therebetween. The sheets of paper to be bound are fed into a space between the two units, and by moving and driving the two units synchronously, stapling performance is conducted at desired positions of the sheets of paper to be bound. By constructing the stapler in this manner, a mechanism for pivotally holding the two units is not required between the driver unit and the clincher unit. Therefore, both directions for feeding and discharging the sheets of paper to be treated by the copying machine or the like can be freely designed. Accordingly, it is easy to design the machine, for example, in a manner of feeding and discharging the sheets of paper in a certain direction, and it is advantageous that treating speed can be improved.

However, in the above described built-in stapler, it has been necessary to recharge the staples into the magazine of the driver unit. Further, it may sometimes happen, although not so often, that the staple legs ejected from an ejecting passage formed at a forward end of the magazine of the driver unit cannot pass through the sheets of paper, but may be collapsed and jammed in the ejecting passage. In such cases, it has been necessary to move the driver unit to a home position to do a work for recharging the staples into the magazine of the driver unit, and a work for removing the jammed staples from the ejecting passage formed at the forward end of the magazine of the driver unit.

In the related mechanism, the driver unit and the clincher unit are held so as to move synchronously in a state where they are vertically aligned, and the home positions are provided at one ends of respective moving ranges of the two units in order to make the units aligned in position, to do the work for charging the staples and removing the jammed staples in a state where both the units have been moved to the home positions. However, since the home positions of the two units are set at the same position, the clincher unit will be positioned above the magazine of the driver unit in a state where both the units have been moved to the home positions. For this reason, there has been a problem that it has been difficult to do the work for charging the staples into the magazine of the driver unit or removing the jammed staples.

SUMMARY OF THE INVENTION

An object of the invention is to provide a built-in stapler built into a machine in which a driver unit and a clincher unit are held so as to move independently from each other, and it is possible to easily conduct a work for recharging staples into a magazine of the driver unit or a work for removing jammed staples which have been jammed in an ejecting passage at a forward end of the magazine.

In order to solve the above described problem, according to the invention, there is provided a built-in stapler comprising: a driver unit for ejecting staples, which have been charged in a magazine thereof, against sheets of paper to be bound by means of a motor driven driver; and a clincher unit for folding legs of the staples, which have passed the sheets of paper to be bound, along a back face of the sheets of paper. The driver unit and the clincher unit are constructed independently from each other, and held with a determined distance therebetween so as to freely move. Stopping positions at one ends of respective moving ranges of both the units are set to be displaced from each other, and at the same time, the stopping position of one of the units is provided at an inner side in the moving range than the stopping position of the other unit.

Figure 1:
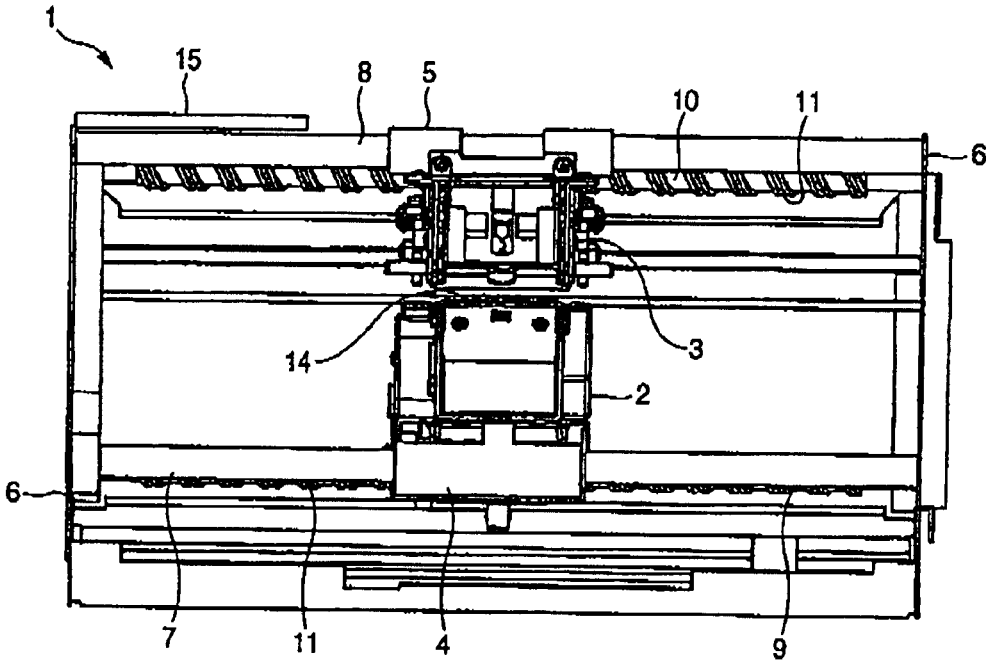
FIG. 1 is a front view of a built-in stapler, in a state of usual stapling performance.

Note that in the drawings, reference numeral 1 denotes an electric stapler, 2 denotes a driver unit, 3 denotes a clincher unit, 4 denotes a guide sleeve, 5 denotes a guide sleeve, 6 denotes a frame, 7 denotes a guide rod, 8 denotes a guide rod, 9 denotes a drive shaft, 10 denotes a drive shaft, 11 denotes a helical groove, 12 denotes an engaging piece, 13 denotes an engaging piece, 14 denotes a paper passage, 15 denotes a stopper, and 16 denotes a spring.

DESCRIPTION OF THE PREFERRED EMBODIMENTS

Now, a mode for carrying out the invention will be described referring to an embodiment which is shown in the drawings. FIG. 1 shows an electric stapler which is incorporated in a business machine such as a copying machine, a printing machine, a facsimile machine, etc. for the purpose of automatically binding a determined number of sheets of paper which have been copied, printed or received by facsimile. The electric stapler 1 comprises: a driver unit 2 having a magazine in which a number of staples are charged, a driver plate for ejecting the staples in the magazine against the sheets of paper to be bound, and a drive mechanism for driving the driver plate; and a clincher unit 3 having a movable clincher mechanism for folding legs of the staple which have passed the sheets of paper to be bound along a back face of the sheets of paper, and a drive mechanism for driving the clincher mechanism. Both the units 2, 3 are integrally provided with guide sleeves 4, 5 respectively, and are held, by way of the guide sleeves 4, 5, on guide rods 7, 8 which are bridged between two frames 6 formed on opposite sides in the business machine so as to freely slide.

Figure 3:
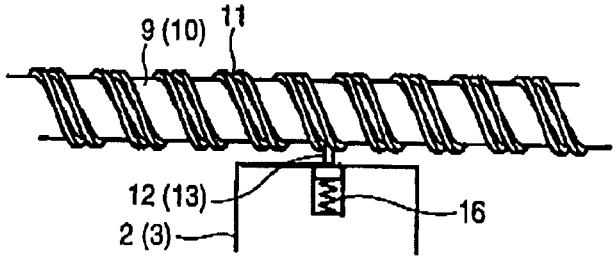
FIG. 3 is a front view showing relation between an engaging piece of a clincher unit and a drive shaft, in a same state as in FIG. 1.
Figure 4:
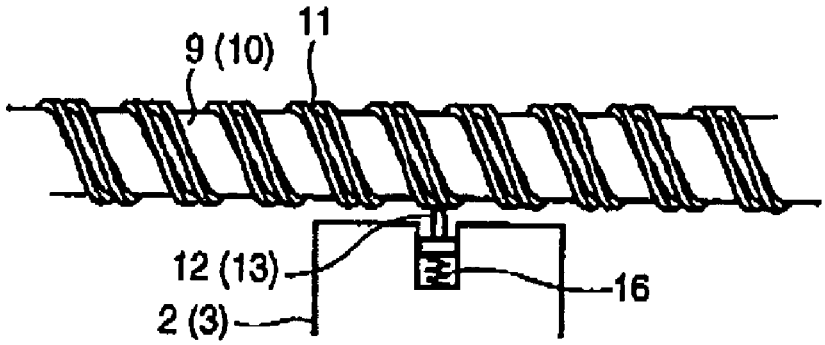
FIG. 4 is a front view showing relation between the engaging piece of the clincher unit and the drive shaft, in a same state as in FIG. 2.

Drive shafts 9, 10 for moving the units 2, 3 along the guide rods 7, 8 are disposed between the frames 6 on the opposite sides, in parallel to the guide rods 7, 8 which guide the driver unit 2 and the clincher unit 3 in a slidable manner. Helical grooves 11 having a same pitch are provided on respective outer peripheral walls of the drive shafts 9, 10. As shown in FIGS. 3 and 4, the driver unit 2 and the clincher unit 3 are respectively provided with engaging pieces 12, 13 which are projected toward the relevant drive shafts 9, 10. The engaging pieces 12, 13 are engaged with the above mentioned helical grooves 11, so that they can be moved along the guide rods 7, 8 with rotation of the drive shafts 9, 10 thereby to conduct stapling performance at a desired position of the sheets of paper to be bound.

Figure 5:
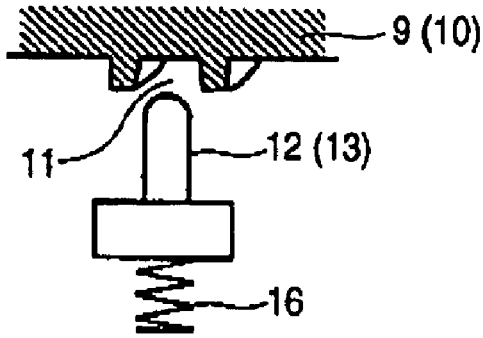
FIG. 5 is an enlarged sectional view showing structures of the drive shaft and the engaging piece.

Rotation angles and rotation speeds of the drive shafts 9, 10 for moving the driver unit 2 and the clincher unit 3 are synchronous with each other, and the driver unit 2 and the clincher unit 3 are moved on the guide rods 7, 8 in the same direction in a state where they are aligned with each other in a vertical direction. In this manner, the position of the staple which has been ejected from the driver unit 2 and the position of the clincher unit 3 will not be displaced from each other, and the stapling performance can be reliably conducted at the desired position to which the units have moved. The helical grooves 11 formed on the outer peripheral faces of the drive shafts 9, 10 have a substantially trapezoidal shape in a sectional view in such a manner that a bottom part of the groove becomes narrow, as shown in FIG. 5, in order to reliably transmit the rotation of the drive shafts to the directions, of moving the units 2, 3.

The driver unit 2 and the clincher unit 3 are opposed to each other having a distance therebetween in a vertical direction, interposing a paper passage 14 through which the sheets of paper to be bound which have been treated by the copying machine or the like are adapted to pass. The driver unit 2 and the clincher unit 3 are respectively driven in order to conduct the stapling performance at a determined position of the sheets of paper to be bound which have been fed to the paper passage 14 formed between the two units 2, 3. Controls for moving the two units 2, 3 to the stapling position and driving the driver unit 2 and the clincher unit 3 to conduct the stapling performance on the sheets of paper to be bound are conducted by a control device which is provided on the business machine such as the copying machine, at the same time with controls of the treatments such as copying, and feeding and discharging processes of the sheets of paper.

Figure 2:
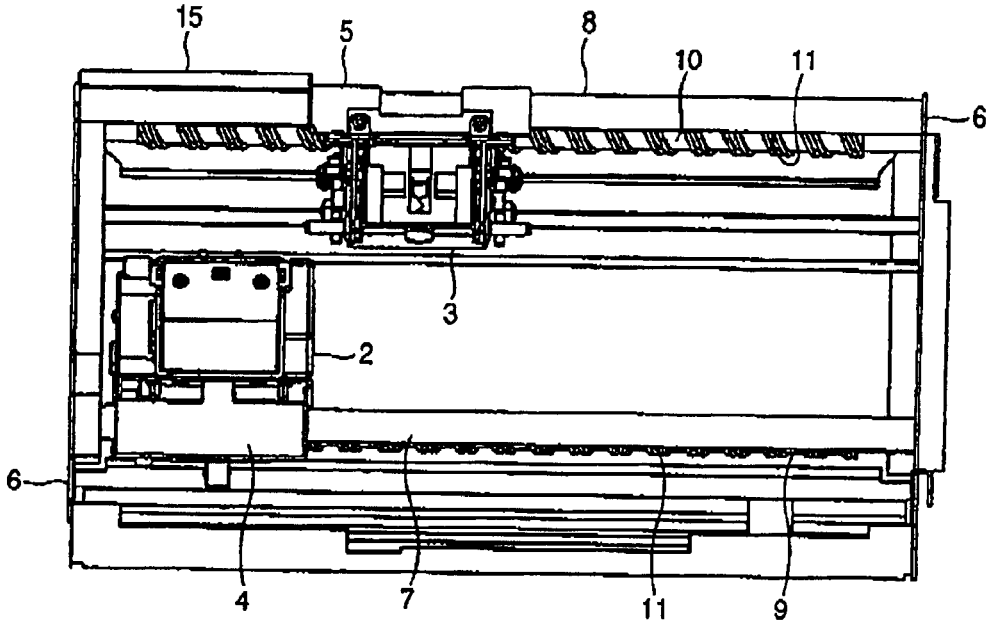
FIG. 2 is a front view similar to FIG. 1 showing the built-in stapler, in a state for charging staples.

A stopper 15 is formed at one side in a moving range of the clincher unit 3 for the purpose of restricting the moving range of the clincher unit 3 in a direction of the one side. When an end of this stopper 15 has come into contact with an end of the guide sleeve 5 of the clincher unit 3, the clincher unit 3 is restrained from moving and stopped. There is no stopper formed at one side of a moving range of the driver unit 2, and accordingly, the driver unit 2 can further move up to the one side beyond the stopping position of the clincher unit 3, as shown in FIG. 2.

As shown in FIGS. 3 and 4, the engaging pieces 12, 13 which are respectively provided in the driver unit 2 and the clincher unit 3 and adapted to be engaged with the helical grooves 11 of the drive shafts 9, 10 are urged by springs 16 so as to project from the respective units 2, 3 toward the drive shafts 9, 10. By action of these springs 16, tip ends of the engaging pieces 12, 13 will be engaged with the helical grooves 11 so as to be received therein. When the magazine of the driver unit 2 becomes empty of the staples, or in case where the staples have been jammed in a staple ejecting passage at the forward end of the magazine, instructions will be given by way of the above described control device to recharge the staples or to remove the jammed staples. When controls of the works are actuated, the drive shafts 9, 10 are driven to rotate, and the driver unit 2 and the clincher unit 3 are moved toward the one side in the state where they are vertically aligned with each other. When the clincher unit 3 has been stopped by the above described stopper 15, the engaging piece 13 of the clincher unit 3 will retreat into the clincher unit 3 along with further rotation of the drive shaft 10, resisting the urging force of the spring 16, thereby to be disengaged from the helical groove 11. On this occasion, since the helical groove 11 has a trapezoidal shape in a sectional view as described above, the engaging piece 13 can be easily disengaged from the helical groove 11. The driver unit 2 further moves toward the one side by the rotation of the drive shaft 9 until it stops at the end of the moving range, since no stopper is provided at the one side.

Accordingly, in a state where the driver unit 2 and the clincher unit 3 have been moved toward the one side in order to do the work for charging the staples or the work for removing the jammed staples, the vertical alignment between the driver unit 2 and the clincher unit 3 will be released. Because the driver unit 2 will be further moved up to the one side beyond the clincher unit 3, a space will be created on an upper face of the driver unit 2, which will facilitate operation for recharging the staples into the magazine of the driver unit 2 and the work for removing the jammed staples in the staple passage at the front end of the magazine of the driver unit 2.

After the operation of charging the staples into the magazine of the driver unit 2 and the work for removing the jammed staples in the staple passage at the front end of the magazine have been finished, the drive shafts 9, 10 are rotated in a reverse direction to drive both the units 2, 3 to the ends at the opposite side and manage the engaging piece 13 of the clincher unit 3 to be engaged again with the helical groove 11 of the drive shaft 10, at the determined position. On this occasion, as the engaging piece 13 of the clincher unit 3 is engaged with the helical groove 11 of the drive shaft 10 at a desired position, the clincher unit 3 will be moved toward the other side preceding the driver unit 2, and stopped at the home position which is formed at the other end. Then, the engaging piece 13 will be disengaged from the helical groove 11. As the drive shafts 9, 10 further rotate, the driver unit 2 will be moved to the home position. At this time point, the engaging piece 13 of the clincher unit 3 will be engaged with the helical groove 11 of the drive shaft 10 at the original position, whereby the driver unit 2 and the clincher unit 3 become able to move together in the state vertically aligned with each other, and can conduct the stapling performance after they have moved to a desired position. Alternatively, the stapler may be constructed in such a manner that while the driver unit 2 is stopped by the stopper, the clincher unit 3 can further move toward in a direction of the one side.

It would be apparent that the invention is not restricted to the above described embodiment, but various modifications can be made within the technical scope of the invention, and those which have been modified are also construed to belong to the invention.

The present invention is based on Japanese Patent Application filed on Sep. 11, 2001 (Japanese Patent Application No. 2001-275405), the contents of which are hereby incorporated by reference.

INDUSTRIAL APPILCABILITY

As described, according to the invention, the stopping position of the driver unit 2, where the works for charging the staples and removing the jammed staples are operated, is set so that the driver unit 2 can move to an inner side of the moving range than the stopping position of the clincher unit 3 which is arranged above the driver unit. As the results, a large space can be created above the magazine of the driver unit 2, and it is possible to easily conduct the works for charging the staples and removing the jammed staples, without being hindered by the clincher unit 3.

What is claimed is:

1. A built-in stapler built into a machine comprising:

a driver unit that ejects staples charged in a magazine of the built-in stapler, against sheets of paper to be bound by means of a motor driven driver; and a clincher unit that folds legs of the staples passed the sheets of paper to be bound, along a back face of the sheets of paper, wherein said driver unit and said clincher unit are respectively constructed independently from each other, said driver unit and said clincher unit are held with a determined distance therebetween so as to move respectively, and stopping positions at one ends of respective moving ranges of said driver unit and said clincher unit are set to be displaced from each other, and the stopping position of either one of said driver unit and said clincher unit is provided at an inner side in the moving range than the stopping position of the other unit.

2. The built-in stapler according to claim 1, further comprising a stopper that restricts the moving range of either one of said driver unit and said clincher unit.

3. The built-in stapler according to claim 1, further comprising:

a first drive shaft including a first helical groove on its outer peripheral face and adapted to move said driver unit;

a second drive shaft including a second helical groove on its outer peripheral face and adapted to move said clincher unit;

a first engaging piece, provided in said driver unit, movably projecting toward said first drive shaft, and adapted to be engaged with said first helical groove; and a second engaging piece, provided in said clincher unit, movably projecting toward said second drive shaft, and adapted to be engaged with said second helical groove.

4. The built-in stapler according to claim 3, wherein said first helical groove and said second helical groove are formed to have such a sectional shape that bottom parts of the respective grooves become narrow.

5. The built-in stapler according to claim 3, further comprising a stopper for restricting the moving range of either one of said driver unit and said clincher unit.

6. The built-in stapler according to claim 5, wherein said first engaging piece is disengaged from said first helical groove, when said driver unit is stopped by said stopper.

7. The built-in stapler according to claim 5, wherein said second engaging piece is disengaged from said second helical groove, when said clincher unit is stopped by said stopper.

* * * * *